United States Patent [19]

Isella

[11] 4,307,499

[45] Dec. 29, 1981

[54] APPARATUS FOR OBTAINING THE SPACING OF ZIP FASTENERS

[75] Inventor: Giuseppe Isella, San Damiano, Italy

[73] Assignee: Brevetti Motta s.a.s., Milan, Italy

[21] Appl. No.: 102,158

[22] Filed: Dec. 10, 1979

[30] Foreign Application Priority Data

Dec. 11, 1978 [IT] Italy ..... 23519/78[U]

[51] Int. Cl.[3] ..... B26D 1/25; B29D 5/00

[52] U.S. Cl. ..... 29/33.2; 29/34 A; 29/408; 29/766; 72/325; 83/921

[58] Field of Search ..... 29/33.2, 33 K, 34 A, 29/408, 766, 770, 564.3; 83/688, 921; 72/325

[56] References Cited

U.S. PATENT DOCUMENTS 1,675,910 7/1928 Riker ..... 72/325

1,837,451 12/1931 Lee ..... 72/325

3,106,749 10/1963 Streicher ..... 29/408 X 3,368,269 2/1968 Perlman ..... 29/33.2

3,538,582 11/1970 Perlman ..... 29/408 X

*Primary Examiner*—Z. R. Bilinsky

*Attorney, Agent, or Firm*—Cushman, Darby & Cushman

[57] ABSTRACT

For obtaining the spacing of continuously manufactured zip fasteners by removing in a single operation the connecting members over a certain length, a device is provided which comprises a die and a stepped punch with three rectangular sections. The punch is guided in a tape pressure which holds at standstill the tapes of the fastener coupled by means of the connecting members against the die. The three sections of the stopped punch have dimensions proportioned with respect to the dimensions of the connecting members to be removed.

1 Claim, 6 Drawing Figures

APPARATUS FOR OBTAINING THE SPACING OF ZIP FASTENERS

The instant innovation relates to a device for obtaining the spacing of zip fasteners manufactured continuously having connecting members made by die-casting on the borders of supporting tapes.

It is known that zip fasteners are composed of two supporting tapes or ribbons which along their borders carry metal members or plastic members destined to be brought into mutual engagement or disengagement by means of a slider.

Those tapes or ribbons with the respective connecting members are produced by continuous process and are mutually coupled so as to form long footages from which the individual zippers of desired length can be severed. Since in the practical use of a zip fastener a certain portion is needed in correspondence with the two ends of the couple of tapes, which is without any teeth or connecting members, it is necessary to remove such members over a certain length, between one individual zip fastener and the subsequent one, from the couple of continuous tapes. This procedure of removal of the teeth is commonly called the spacing operation.

It would be possible of course to space already in the stage of production of the continuous tapes, the individual zip fasteners, but this would involve the inconvenience of being bound to predetermined lengths of the individual zip fasteners, whilst it is well known that zip fasteners are used in most varied lengths.

Heretofore the spacing of the zip fasteners of the kind indicated above used to be carried out by means of a blade-shaped punch or piecer made to pass between the two tapes of support coupled in such a manner as to remove the central portion of the teeth or connecting members, while there remained on the borders of the tapes the lateral portions which were taken away in a subsequent stage by means of rotating brushes.

It is an object of the present innovation to provide a device able to carry out by a single operation the complete removal of the connecting members in the desired portion.

This object is attained according to the innovation by means of a device constituted by a shearing press with a die and a guided punch, characterized in that the punch is made with steps with three rectangular sections and is guided in a tape presser apt to keep at standstill the tapes coupled by means of the connecting members in the vicinity of the latter against the die.

The features and the operation of the device according to the innovation will become more fully clear from the following description with reference to the accompanying drawings wherein.

Figure 1:
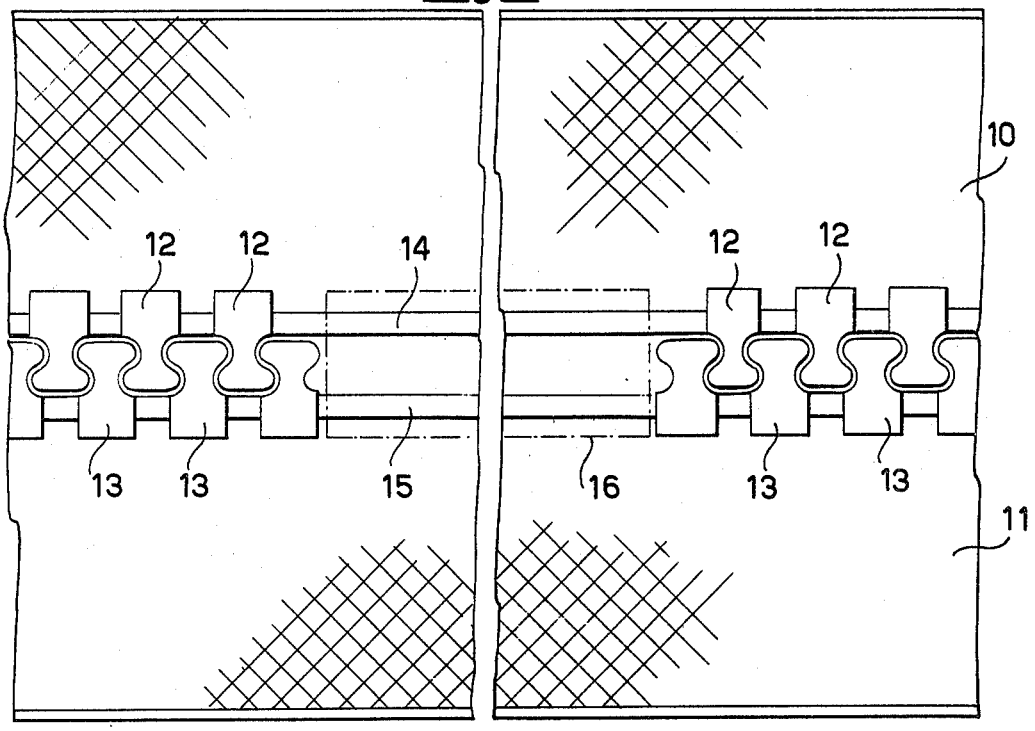
FIG. 1 shows in plan the continuous supporting tapes coupled in the spacing zone.

As can be seen in FIG. 1, two continuous supporting tapes respectively indicated by reference numerals 10 and 11 are coupled with each other by means of small teeth or connecting members 12 and 13 respectively, obtained by die-casting, at the borders of said tapes.

From FIGS. 2–6 it appears that the borders, 14 and 15 respectively, of the tapes 10 and 11, are thickened.

The tapes are normally of fabric or they may be constituted by flexible plastic sheets, whilst the small teeth made by die-casting on the borders of the tapes may be of hard plastic or of metal. The shape of the small teeth illustrated is merely indicative and they may even be differently profiled, provided they permit safe mutual coupling.

At the centre of FIG. 1 there is marked by a dotted line the spacing zone 16, namely the zone in which the teeth 12 and 13 are to be removed from the respective borders 14 and 15 of the tapes 10 and 11 in order to separate one individual zip fastener from the subsequent one.

Figure 2:
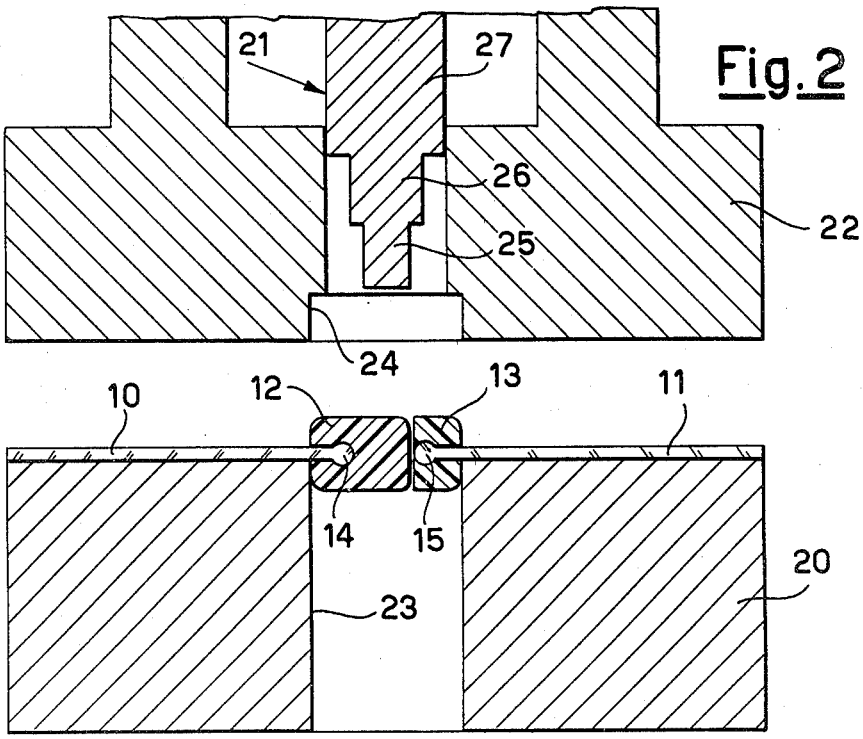
FIG. 2 is a vertical cross-section of the shearing device prior to carrying out the spacing operation.

The device for carrying out the spacing operation is diagrammatically illustrated in FIG. 2. It consists substantially in a shearing press with a die 20, a punch 21 and a tape presser 22 in which the punch 21 is guided. The tape presser 22 and the punch 21 are displaceable independently of each other by rectilinear motion from a lifted position at distance from the die 20 towards the latter and viceversa.

The die 20 has a hole 23 the width of which corresponds to the overall width of the teeth 12 and 13 in coupled condition and the length of which corresponds to the desired length of the spacing zone.

Also the tape presser 22 has a cavity 24 open downwards and destined to receive the upper part of the coupled teeth 12, 13 when the tape presser 22 is lowered onto the die 20 to hold at standstill the tapes 10 and 11 during the spacing operation (FIGS. 3–6).

Characteristically, according to the innovation the punch 21 has a shape with steps, namely a first narrow section, a second wider section and a third even more widened section; these three sections are indicated respectively by the reference numerals 25, 26 and 27. All of the three sections are rectangular and have a length equal to the length of the desired spacing zone: the first section 25 has a width slightly smaller than the distance between the borders 14 and 15 of the two tapes 10, 11 with the teeth 12 and 13 being coupled; the second section 26 has a width about equal to said distance between the borders 14 and 15 and the third section 27 is wider than said distance but slightly narrower than the distance between the external borders of the teeth 12 and 13 coupled, as clearly visible in FIGS. 2 through 6.

To carry out the spacing, the two coupled tapes are arranged on the die 20 with their teeth in mutual engagement on the hole 23 thereof (FIG. 2).

Then the tape presser 22 is lowered to hold the tapes 10 and 11 firmly still in their position on the die 20 and successively the punch 21 is lowered.

Figure 3:
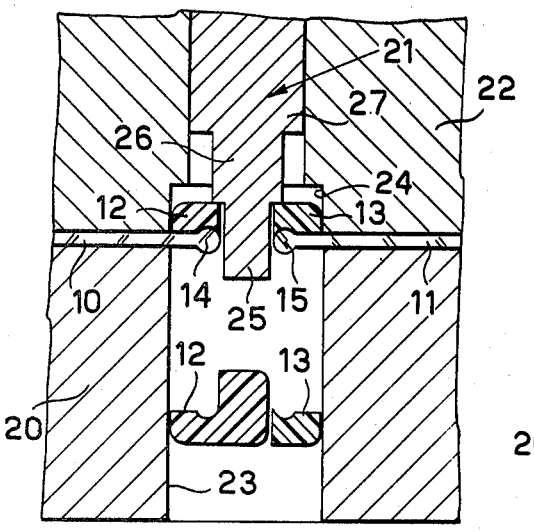
FIGS. 3 through 6 show in analogous sections like FIG. 2 various successive working steps.

In its descent, the first section 25 of the punch first shears the central portion of the coupled teeth 12 and 13 and causes the separation of this portion together with the lateral lower parts of the teeth from the borders 14 and 15 of the tapes (see FIG. 3). The portion removed falls into the hole 23 of the die.

Figure 4:
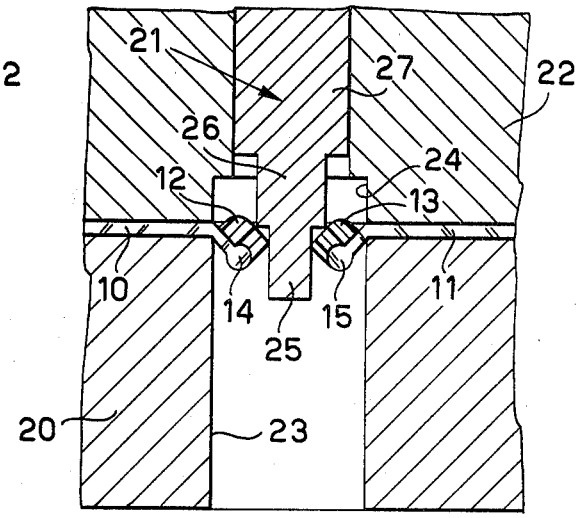
Figure 5:
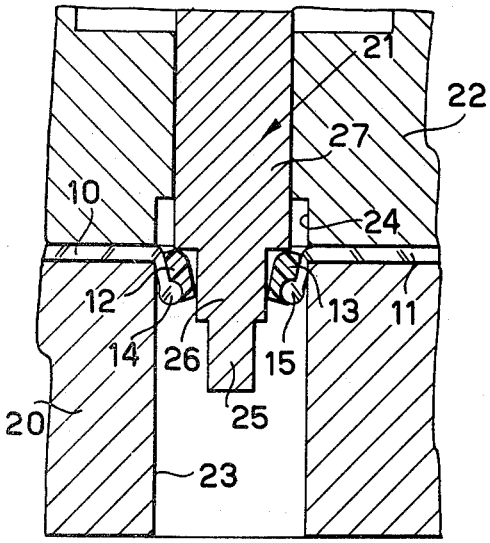

Successively the second section 26 of the punch 21 comes into action and acts upon the upper lateral parts of the teeth which by now have undergone shearing, and slightly bend the borders of the tapes downwards (see FIG. 4).

Figure 6:
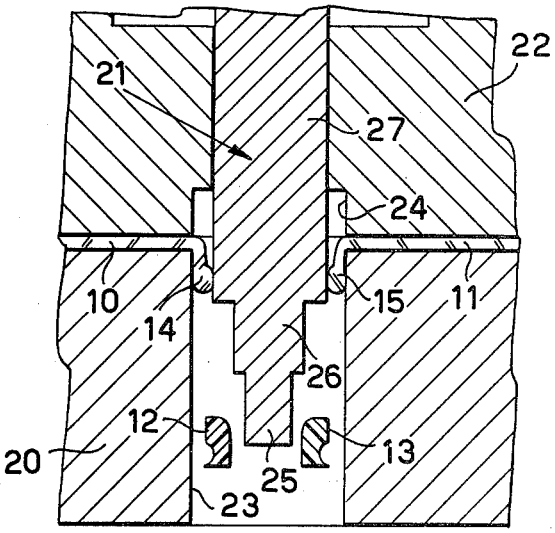

Finally the third section 27 of the punch 21 (FIG. 5) comes to act further upon the upper lateral parts of the teeth having undergone shearing to eject at the end these parts thanks to the space existing between the second section 26 and the borders 14, 15 of the tapes squeezed against the side walls of the hole 23 of the die 20 (see FIG. 6).

From the above it clearly appears how by means of the device according to the innovation it becomes possible to completely eliminate by one single operation the small teeth in the spacing zone.

It also appears evident how this result is obtained thanks to the stepped punch the three successive sections of which should have dimensions well proportioned with respect to the dimensions of the small teeth to be removed.

I claim:

1. A device for obtaining the spacing of zip fasteners manufactured by a continuous process and having connecting members provided by die-casting on the borders of supporting tapes or ribbons, said device comprising a die having a through hole, a punch stepped with three rectangular sections, a tape presser guiding the punch and capable of holding at standstill the tapes coupled by means of the connecting members in the vicinity thereof against the die, said tape presser having a cavity open downwards, the width of said through hole and of said cavity being substantially equal to the overall width of the connecting members in coupled condition, said first section of said punch having a width slightly smaller than the distance between the borders of the tapes with the connecting members being coupled, said second section having a width about equal to said distance between the borders of the tapes and said third section being wider than said distance but slightly narrower than the distance between the external borders of the coupled connecting members.

* * * * *